US007423617B2

(12) United States Patent
Giraldo et al.

(10) Patent No.: US 7,423,617 B2
(45) Date of Patent: Sep. 9, 2008

(54) LIGHT EMISSIVE ELEMENT HAVING PIXEL SENSING CIRCUIT

(75) Inventors: Andrea Giraldo, S-Hertogenbosch (NL); Mark Thomas Johnson, Veldhoven (NL)

(73) Assignee: TPO Displays Corp., Chu-Nan (TW)

( * ) Notice: Subject to any disclaimer, the term of this patent is extended or adjusted under 35 U.S.C. 154(b) by 280 days.

(21) Appl. No.: 10/533,922

(22) PCT Filed: Nov. 3, 2003

(86) PCT No.: PCT/IB03/04892

§ 371 (c)(1),
(2), (4) Date: May 3, 2005

(87) PCT Pub. No.: WO2004/042413

PCT Pub. Date: May 21, 2004

(65) Prior Publication Data

US 2006/0015272 A1 Jan. 19, 2006

(30) Foreign Application Priority Data

Nov. 6, 2002 (EP) ..... 02102545

(51) Int. Cl.
*G09G 3/32* (2006.01)

(52) U.S. Cl. ..... 345/82; 345/100

(58) Field of Classification Search ..... 345/60–100, 345/211–213
See application file for complete search history.

(56) References Cited

U.S. PATENT DOCUMENTS

| | | | | |
|---|---|---|---|---|
| 5,432,461 | A | 7/1995 | Henley | |
| 6,842,160 | B2 * | 1/2005 | Yamazaki et al. | 345/76 |
| 2002/0181276 | A1 * | 12/2002 | Yamazaki | 365/175 |
| 2003/0063053 | A1 * | 4/2003 | Yamazaki et al. | 345/82 |
| 2004/0085270 | A1 * | 5/2004 | Kimura | 345/82 |

FOREIGN PATENT DOCUMENTS

| | | | |
|---|---|---|---|
| EP | 1130166 | A2 | 9/2001 |
| EP | 1130166 | B1 | 9/2001 |
| EP | 1130166 | A3 | 8/2003 |
| WO | WO 01/22504 | A1 | 3/2001 |

* cited by examiner

*Primary Examiner*—Richard Hjerpe
*Assistant Examiner*—Shaheda A Abdin
(74) *Attorney, Agent, or Firm*—Liu & Liu

(57) ABSTRACT

A method for sensing a light emissive element in an active matrix display pixel cell further including a data line connectable to a drive element and to a first electrode of the emissive element. The data line is connected to the anode of the emissive element, and a sensing voltage to reverse bias the emissive element, and detecting any leakage current flowing through the emissive element.

20 Claims, 3 Drawing Sheets

LIGHT EMISSIVE ELEMENT HAVING PIXEL SENSING CIRCUIT

BACKGROUND OF THE INVENTION (1) Field of the Invention

The present invention relates to method for sensing a light emissive element in an active matrix display pixel cell. It also relates to an active matrix display, comprising a plurality of pixel cells each having a current driven light emissive element such as an organic or polymer light emitting diode and a data line connectable to a drive element and to an electrode of the emissive element.

(2) Description of Related Art

Defects or structural inhomogeneities, for example particles from the substrates or from the processing of the device and pinholes and hillocks in the layers, are a severe problem for the lifetime of all OLED displays (including polymer and small molecules, segmented, passive matrix and active matrix displays).

Initial screening and burn-in procedures can be applied to reduce defects appearing during the manufacturing process, but such defects can also be activated during the lifetime of the display.

A selection criteria for identification of any defective pixels in a matrix display during the initial screening and during operation has previously been proposed in WO 01/22504. According to this technique, the stability of the OLED can be checked by applying a reverse voltage over the OLED and detecting the resulting leakage current variation over time. Such a leakage current is small in the ideal device, but will be significantly larger if a defect is present. Therefore, defective pixels can be identified. On the contrary, in forward mode when the diode is ON, the current flowing through the diode is large, and any current contribution from a defect is hidden. This is illustrated in FIG. 1.

The same effect can be utilized for using the pixel as a sensor. When subject to external influence, such as light, temperature, color, radiation or physical contact, the leakage current of the OLED will be altered. This alteration can be detected in the same way as mentioned above with regards to defects in the OLED.

Techniques for correcting pixel defects have also been proposed for passive and active matrix displays. Strong voltage pulses are applied to an OLED in reverse mode. This high field can induce a high current to either heal or isolate a defect in a pixel.

In the case of active matrix, a simple circuit with two transistors (the addressing and the driving transistor) is considered. The pixel circuit is voltage controlled through the data line by the column driver. In normal addressing, after selection of the pixel the voltage is written to the store point, and this controls the current flowing through the driving transistor to the OLED from the power line. Therefore the OLED emits light according to the voltage supplied to the store point.

In this case known techniques for correcting defects consists of applying on the power line a voltage which is negative with respect to the OLED cathode. Thus a negative voltage is provided across the driving transistor and the OLED. When the OLED is reverse biased in such a way, the current flowing through the driving transistor is usually much smaller than when the OLED is forward biased and therefore the driving transistor is only slightly open. In order to have maximum voltage drop across the OLED the driving transistor should operate in linear mode. In this way the source-drain voltage is minimized. However, since the voltage of the OLED anode is not directly controlled and the transistor is very wide (=capable of large current even at low voltage) operation of the transistor in linear mode is very difficult to realize.

BRIEF SUMMARY OF THE INVENTION

An object with the present invention is to overcome this problem, and to provide an improved reverse biasing of the light emissive element in an active matrix display.

According to a first aspect of the invention, this object is achieved by a method of the kind mentioned by way of introduction, wherein, during repeated output periods, the data line is connected to the drive element, and a drive signal is provided on the data line to cause the emissive element to generate light, and, during a sensing period between two output periods, the data line is connected to the emissive element first electrode, for example the anode, providing on the data line a sensing voltage, which is negative in respect of the emissive element cathode voltage, thereby reverse biasing the emissive element, and detecting any leakage current, flowing through the emissive element.

According to a second aspect of the invention, the object is achieved by a display device of the type mentioned by way of introduction, further comprising means for providing on the data line a sensing voltage which is negative in respect of an emissive element cathode voltage, thereby reverse biasing the emissive element, and means for detecting any leakage current flowing through the emissive element.

The basic idea of the invention is thus to use the data line of the pixel cell to supply a negative voltage to the emissive element, and to detect any leakage current through the data line. This avoids any problems associated with using the power line for reverse biasing of the emissive element.

Access to the anode of the emissive element from the data line can be realized by adding a switch between the data line and the anode. Some pixel circuits, like the single transistor current mirror (see FIG. 4), already have this switch, in other circuits the switch can be added to form a novel pixel circuit, which is a third aspect of the present invention.

The sensing periods can be preformed recurrently, separated by a predefined number of output periods, e.g. every three output periods.

Preferably, the pixel cell comprises two switches for connecting the data line to the drive element and/or the emissive element anode, respectively. In such a case, the method can further comprise controlling the switches so that, during said sensing period, the data line is connected only to the emissive element anode.

The two switches can be arranged in series between the data line and the drive element, with the anode of the emissive element being connected to a point between the switches. This corresponds to a pixel cell known per se. Alternatively, each pixel cell comprises a first switch, provided between the data line and the drive element, and a second switch provided between the data line and the anode of the emissive element. This is a pixel cell according to the thirds aspect of the invention.

The method can further comprise analyzing the leakage current to determine if the emissive element is defect and, if this is the case, providing to the anode of the emissive element a healing voltage to remove any defect in the emissive element. The healing voltage is adapted to reverse bias the emissive element with a larger voltage than during sensing. Such strong reverse bias has been shown to remove defects in the emissive element. The healing voltage can preferably be applied during the next successive sensing period, i.e. instead of the sensing voltage.

Instead of, or as a complement to, applying a healing voltage, the inventive method can comprise adjusting the drive of the pixel in accordance with the defect. For example, the drive current can be lowered, so that the emissive element emits less light. Alternatively, the defect pixel can be deactivated. In case of such adjustment of the pixel drive, surrounding pixels may also be adjusted, in order to mask the defect, i.e. make it less visible for a user. The adjustment of pixel drive is preferably performed before or during the next successive output period.

It is previously known to use a reverse biased LED as a sensor. The method according to the invention can therefore further comprise analyzing the reverse bias current to determine if the emissive element has been subject to any external influences, such as light, temperature, color, radiation or physical contact.

The current driven emissive element can be a light emitting diode, such as an organic light emitting diode (OLED).

These and other aspects of the invention will be apparent from the preferred embodiments more clearly described with reference to the appended drawings.

Figure 1:
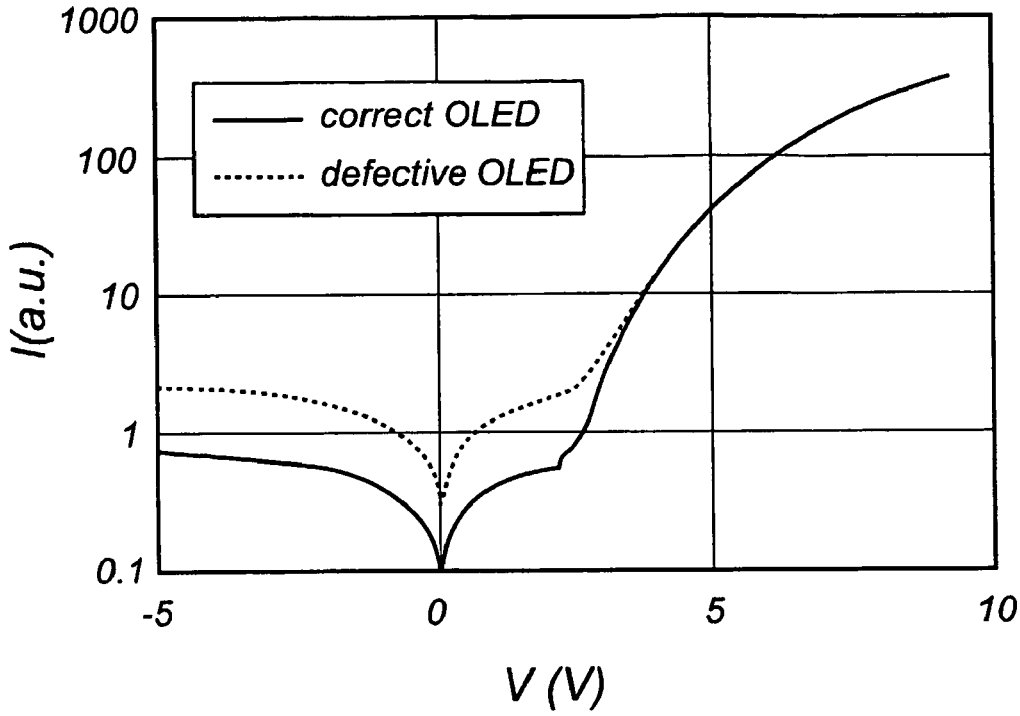
FIG. 1 shows a diagram of the current through an OLED as a function of the voltage.
Figure 2:
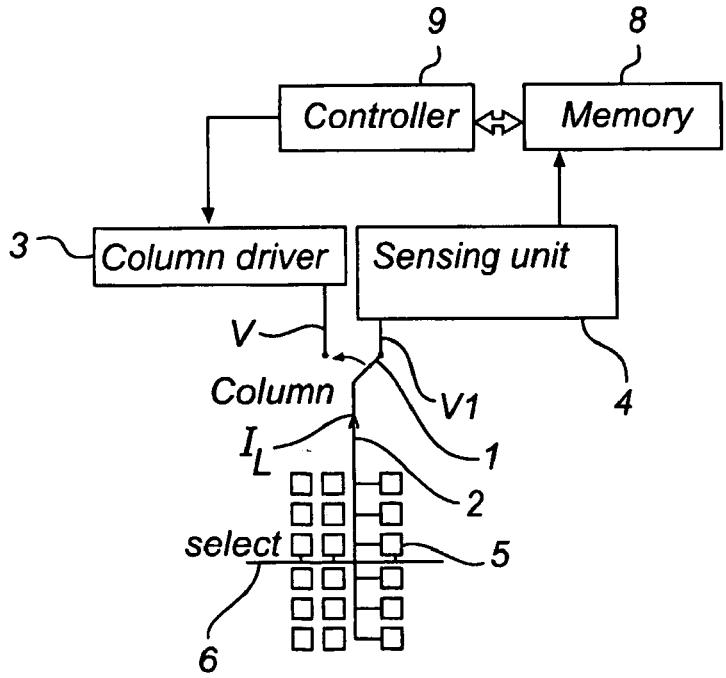
FIG. 2 is a schematic block diagram of a device according to an embodiment of the invention.

The function of the invention is schematically illustrated by the block diagram in FIG. 2.

DETAILED DESCRIPTION OF THE INVENTION

By means of a switch 1 on the top of the data column line 2 outside the display area, the data column line 2 can be switched between a conventional column driver 3 providing a drive signal, here a voltage (V) but alternatively a current, representing image display data, and a sensing unit 4 providing a negative (with respect to the OLED cathode) sensing voltage (V1). This negative voltage will reverse bias the OLED in the currently addressed pixel cell 5, and enable a leakage current (IL) to flow through the data column line 2.

The method according to the invention requires a special addressing dividing the time into output periods and sensing periods. During the output periods (or frames) the switch 1 is connected to the column driver 3 and data is programmed into the pixels 5 to light up the OLED. In between these output periods, the switch 1 is connected to the sensing unit 4. The pixels 5 are then unlit and instead leakage currents IL from the OLEDs are detected.

It is not necessary that the two types of periods (the sensing and the output period) are alternated, since sensing does not require such a high rate as the output.

In some application the sensing can be performed irregularly, for example every time the device is switched on. In the example shown in FIG. 3, the sensing is performed every three frames.

During sensing, just as during output, a normal line scanning is employed to allow access to each single pixel, typically line-by-line. The currently scanned line is determined by the signal on the row select line 6. However, the select signal (or select signals, as will be described in the following) will be different depending on whether the current period is an output period or a sensing period. During an output period, the data column with pixel data voltage V (or data current I) is connected to the store point of each pixel 5. During a sensing period, the data column with sensing voltage V1 is instead connected to the OLED anode in each pixel. This will be further described in the following.

The sensing unit 4 further includes means for detecting the leakage current flowing through the OLED during reverse feed. By accessing a memory 8, the detected current IL can be compared with a threshold to detect high leakage and with previous measurements to check stability (fluctuation or increase/decrease). The detected current can then be stored into the memory 8. As mentioned in the introduction, the detected leakage current IL can be used as a sensor signal, or as an indicator of a defect pixel.

The memory 8 is also accessible from a controller 9 communicating with the column driver 3. This enables the controller 9 to adjust the pixel drive voltage V during the next output period.

The sensing unit can further be arranged to alternatively provide a stronger reverse voltage V2, which, in the same way as the sensing voltage V1, can be applied to the pixels. This voltage V2 will be referred to as a healing voltage, as it is intended to fuse the OLED, thereby hopefully removing the defect.

Such fusing has been described in co-pending European application EP01130166.0, hereby incorporated by reference.

Figure 3:
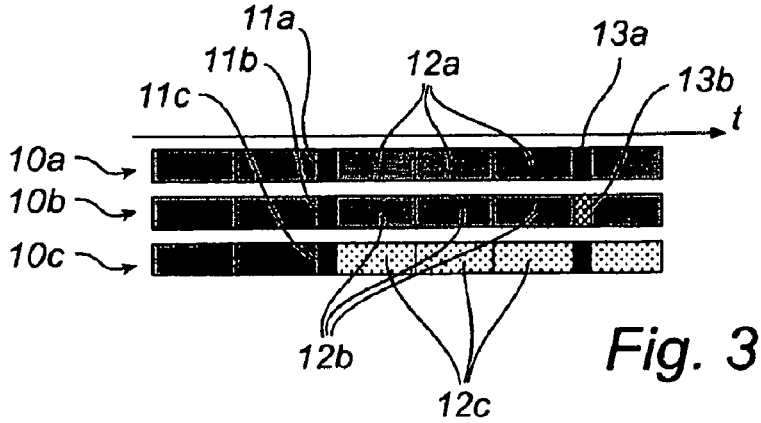
FIG. 3 is a timing diagram illustrating different drive schemes according to the invention.

FIG. 3 shows examples of timing diagrams relating to different defect correction strategies.

In the first case 10*a*, no defect is detected during the first sensing period 11*a*, and the pixel can continue to function as usual during the output periods 12*a*, and will be sensed again during the next sensing period 13*a*.

In the second case 10*b*, a defect is detected during the first sensing period 11*b*. During the successive output periods 12*b* the pixel is driven as usual. During the next successive sensing period 13*b*, a healing voltage is applied to the defective pixel, in an attempt to remove the defect.

Also in the third case 10*c*, a defect is detected during the first sensing period 11*c*, but now the pixel behavior during output periods 12*c* is adapted. The pixel drive can be adjusted to a softer driving, for example simply lowering the data signal voltage to this pixel when it is addressed. It can also be deactivated completely. In both of these cases, the surrounding pixels, or the entire display, can be adapted as well, in order to reduce the impact of the defect pixel, i.e. mask the light output reduction.

Figure 4:
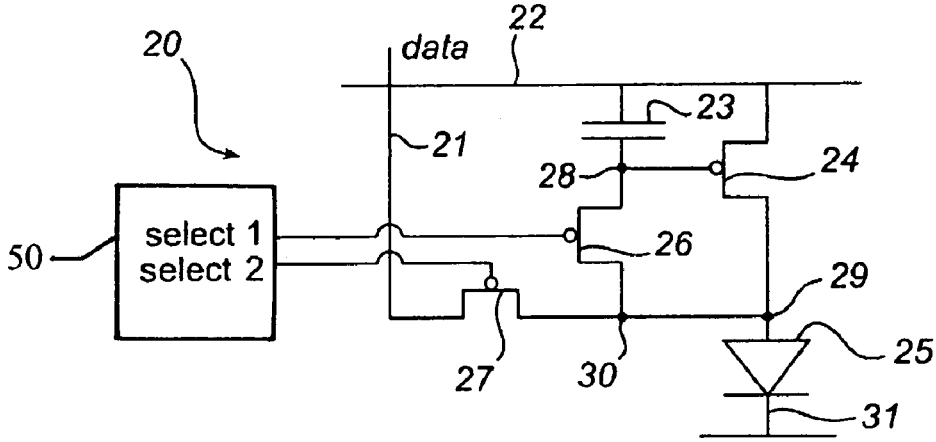
FIG. 4 is a schematic pixel circuit according to prior art, suitable for realizing the device in FIG. 2.

FIG. 4 shows a schematic circuit diagram of a self-compensated (single transistor) pixel cell 20 embodying the invention. The pixel cell 20 has a data line 21, a power line 22, a memory element 23, a drive element 24 and an emissive element in the form of an OLED 25. Two switches 26, 27 are provided in series between a store point 28 and the data line 22, and the OLED anode 29 is connected to a point 30 in between these switches 26, 27. The drive element 24 is a transistor. The drive switches can also be transistors, either of PMOS or NMOS type.

Conventionally, both switches 26, 27 are ON when the pixel is addressed under the control of the controller 50 (column signal fed to the store point 28 and to the OLED anode 29). They are both OFF when the pixel is driving the OLED 25 (voltage provided to the driving element 24 from the memory element 23). This part of the pixel addressing will be employed during the output period.

According to the invention, the pixel is addressed differently during the sensing period. During this period, the first switch 26 is switched OFF while the second switch 27 is switched ON under control of the controller 50. The sensing voltage, which is negative with respect to the OLED cathode voltage 31 is then provided from the data line 21 to the anode 29 of the OLED 25, thereby bringing the diode 25 into reverse mode. This results in a leakage current IL flowing through the OLED 25 and through the data line 21, which current can be detected, stored and analyzed, as described above.

Note that during sensing, the first switch 26 can be controlled simultaneously for all pixels in the display, while the second switch 27 is independent from line to line.

Figure 5:
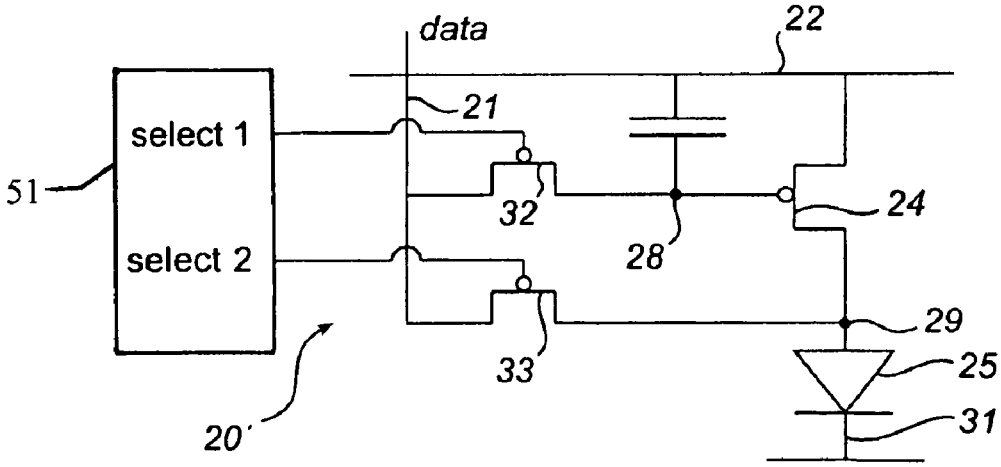
FIG. 5 is a schematic pixel circuit according to an embodiment of the invention, also suitable for realizing the device in FIG. 2.

FIG. 5 shows a schematic circuit diagram of a novel pixel cell 20' according to the invention. Elements corresponding to the elements in FIG. 4 are indicated by identical reference numerals. This pixel is based essentially on a conventional pixel circuit, with one switch 32 connected between the data line and the store point. According to the invention, a second switch 33 is provided between the data line 21 and the OLED anode 29, thereby allowing direct access to the OLED anode 29 from the data line 21.

During the output period, the second switch 33 is OFF, while the first switch 32 is ON during addressing of the pixel, and OFF during driving of the OLED under the control of the controller 51.

During the sensing period, the first switch 32 is switched OFF while the second switch 33 is switched ON under the control of the controller 51. The negative (with respect to the OLED cathode 31) sensing voltage V1 is then applied to the OLED 25 from the data line 21, thereby bringing the diode 25 into reverse mode. Again, this results in a leakage current IL flowing through the OLED 25 and the data line 21, which current can be detected, stored and analyzed as described above.

It can be noted that the two select signals in FIG. 5 may be combined into one, by using complementary switches, such as one NMOS and one PMOS transistor and an appropriate row signal.

In both the described embodiments (FIGS. 4 and 5) the driving element 24 (here a drive transistor) needs to be switched OFF during sensing, in order to minimize the leakage current from the power line 22 through the driving transistor 24, which would otherwise contribute to the detected leakage current IL.

The resetting of the drive transistor 24 is preferably performed initially in the sensing period for all pixels in the display. This can be done without a line-by-line scanning, by simply applying a suitable voltage on all data columns with all rows selected. This voltage should be such that the driving transistors are switched OFF, i.e. do not leak any current.

The resetting can also be obtained by reducing the power line 22 voltage or even by disconnecting the power line 22 completely.

Yet another alternative is to provide an additional switch (not shown) between the OLED anode 29 and the driving transistor 24, to enable disconnection of the drive transistor 24 from the data line, thereby avoiding disturbing the detected leakage current. A combination of some or all of these options is also possible.

FIG. 6*a-d* shows an example of an implementation of the sensing unit 4 in FIG. 2 for voltage programmable pixel circuit like the one described in FIG. 5. The circuit includes an operational amplifier 41 with a negative feedback capacitor 42, working as a charge sensitive amplifier. A switch 43 is provided in parallel with the capacitor 42, so that it is capable of bypassing the amplifier 41.

Figure 6A:
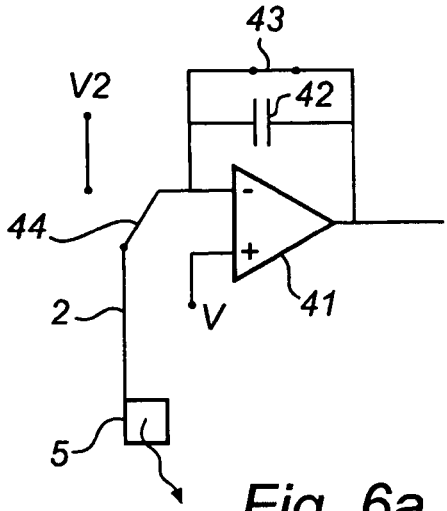
FIG. 6 is a circuit diagram of a section of the sensing unit in FIG. 2.

FIG. 6*a* shows the circuit during normal addressing, i.e. during output periods. In this case, the input of the op-amp 41 is provided with a data column signal (V) from the column driver 3, and the switch 43 is closed. The signal V is thus provided to the addressed pixel 5 via the data column line 2.

Figure 6B:
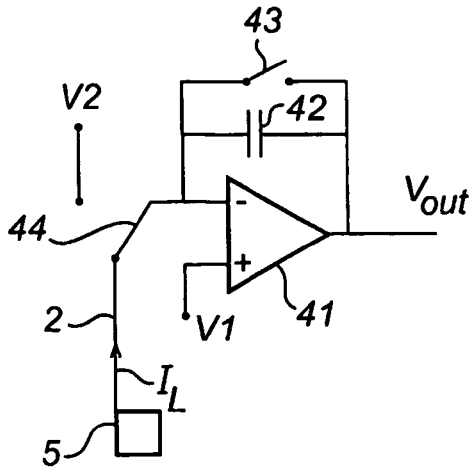

FIG. 6*b* shows the circuit during sensing. Here, the input voltage of the op-amp 41 is the required voltage V1 to set the OLED 25 in reverse mode, and is kept constant. This sensing voltage V1 is provided to the addressed pixel 5 via the data column line 2. The switch 43 is open, thereby enabling the amplifier 41 to receive any leakage current IL from the reverse biased pixel 5, and to send the output voltage V out to the memory 8.

Figure 6C:
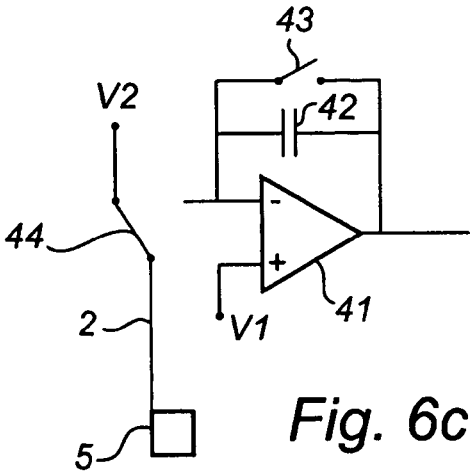

Another switch 44 is arranged to connect the data column 2 directly to a healing voltage V2. To apply this voltage to the data column 2, the switch 44 is switched, thereby disconnecting the data column line from the op-amp 41, and connecting it to the V2 terminal. This is shown in FIG. 6*c*. The healing voltage V2 is then applied to the addressed pixel 5 via the data column line 2. The healing voltage V2 could alternatively be applied by changing the voltage on the input of the amplifier.

Figure 6D:
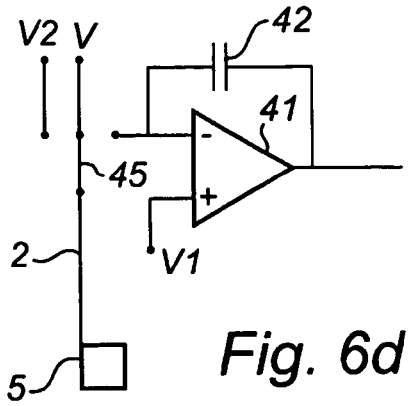

Another alternative is to use a switch 45 to switch between three different terminals, namely V, V2 and the op-amp 41, as shown in FIG. 6*d*. According to this circuit, the op-amp 41 is only connected to the data column line 2 during sensing. During healing, the switch 45 connects the data column 2 to the V terminal, and during healing to the V2 terminal.

Several modifications of the above described embodiments are envisageable for the skilled man. For example, it is clear that while in the present description, data signals are connected column by column, and select signals are connected row by row, this is no limitation of the invention. Neither is it necessary to perform the sensing using the same type of scanning as during output, or, for that matter, using any scanning at all.

Also, other components may be used as switches and drive elements, replacing or supplementing the transistors mentioned above. The memory element does not need to be a capacitor, but can equally well be another type of static memory.

Furthermore, the invention has been described in relation to an OLED display, but it is clear to the skilled man that the principles of the invention can be extended to other current driven emissive displays with active matrix addressing, like for example Field Emission Displays and Electro-Luminescent Displays.

The invention claimed is:

1. A method for sensing a light emissive element (25) in an active matrix display pixel cell (20; 20'), further comprising a data line (21) connectable to a drive element (24) and to a first electrode (29) of the emissive element (25), said method comprising: during repeated output periods, connecting the data line (21) to the drive element (24), and providing on the data line (21) a drive signal (V) to cause the emissive element (25) to generate light, and during a sensing period, between two output periods, connecting the data line (21) to the first electrode (29) of the emissive element (25), providing on the data line (21) a sensing voltage (V1) to reverse bias the emissive element (25), and detecting any leakage current (IL) flowing through the emissive element (25).

2. A method according to claim 1, wherein sensing periods are performed recurrently, separated by a predefined number of output periods.

3. A method according to claims 1, wherein said pixel cell (20; 20') comprises two switches (26, 27; 32, 33) for connecting said data line (21) to the drive element (24) and/or the anode (29) of the emissive element (25), said method further comprising: controlling said switches so that, during said sensing period, the data line (21) is connected only to said first electrode (29).

4. A method according to claim 1, further comprising analyzing the leakage current (IL) to determine if the emissive element (25) has been subject to any external influence.

5. A method according to claim 1, further comprising: analyzing said leakage current to determine if the emissive element (25) is defect and, if this is the case, providing to the first electrode (29) of the emissive element (25) a healing voltage to remove any defect in the emissive element.

6. A method according to claim 4, wherein said healing voltage is applied during the successive sensing period.

7. A method according to claim 1, further comprising: analyzing said leakage current to determine if the emissive element is defect and, if this is the case, adjusting the drive of the pixel in accordance with the defect.

8. A method according to claim 7, wherein the defect pixel is deactivated.

9. A method according to claim 7, wherein the drive of surrounding pixels is adjusted in order to mask the defect.

10. A method according to claim 7, wherein said adjusting step is performed before or during the next successive output period.

11. A method according to claim 1, wherein the emissive element is an organic or polymer light emitting diode.

12. An active matrix display device, comprising a plurality of pixel cells (20; 20') each having a current driven emissive element (25) and means for connecting a data line (21) to the first electrode (29) of the emissive element, further characterized by: means (1; 43, 44) for providing on the data line a sensing voltage (V1) which is negative in respect of an emissive element cathode voltage (31), thereby reverse biasing the emissive element (25), and means (41, 42) for detecting any leakage current flowing through the emissive element.

13. A display device according to claim 12, wherein each pixel cell (20) comprises two switches (26, 27) arranged in series between the data line (21) and the drive element (24), the emissive element first electrode (29) being connected to a point (30) between said switches.

14. A display device according to claim 12, wherein each pixel cell (20') comprises a first switch (32), provided between the data line (21) and the drive element (24), and a second switch (33) provided between the data line (2) and the first electrode (29) of the emissive element.

15. A display device according to claim 12, wherein the emissive element (25) is an organic or polymer light emitting diode.

16. A pixel cell in an active matrix display device, comprising a data line (21), a drive element (24), an emissive element (25), and a first switch (32), provided between the data line (21) and the drive element (24), and a second switch (33) provided between the data line (21) and the anode (29) of the emissive element.

17. A pixel cell according to claim 16, wherein the first switch and the second switch are provided in parallel between the data line and the anode of the emissive element.

18. A method according to claim 1, wherein the first electrode is an anode of the emissive element.

19. A display device according to claim 12, wherein the first electrode is an anode of the emissive element.

20. A method according to claim 3, wherein the first electrode is an anode of the emissive element.

* * * * *